United States Patent [19]

Mueller et al.

[11] Patent Number: 4,685,191

[45] Date of Patent: Aug. 11, 1987

[54] APPARATUS AND PROCESS FOR SELECTIVELY EXPANDING TO JOIN ONE TUBE INTO ANOTHER TUBE

[75] Inventors: Richard A. Mueller; David L. Laughry, both of Tulsa, Okla.

[73] Assignee: Cities Service Oil and Gas Corporation, Tulsa, Okla.

[21] Appl. No.: 862,279

[22] Filed: May 12, 1986

[51] Int. Cl.[4] ..... B21D 39/00; B21D 39/08; B21D 22/10; B23P 15/26

[52] U.S. Cl. ..... 29/523; 29/727; 72/58; 72/62

[58] Field of Search ..... 29/509, 523, 727, 506, 29/507, 157.3 C; 72/57, 58, 60, 61, 62

[56] References Cited

U.S. PATENT DOCUMENTS

| | | | |
|---|---|---|---|
| 1,930,745 | 10/1933 | Fisher | 72/62 |
| 2,704,104 | 3/1955 | Mueller | 72/62 |
| 4,006,619 | 2/1977 | Anderson | 72/58 |
| 4,068,372 | 1/1978 | Kamohara et al. | 29/727 |
| 4,320,568 | 3/1982 | Herrod et al. | 72/62 |
| 4,388,752 | 6/1983 | Vinciguerra et al. | 29/523 |
| 4,418,457 | 12/1983 | Mueller | 29/523 |
| 4,420,866 | 12/1983 | Mueller | 29/523 |
| 4,567,631 | 2/1986 | Kelly | 29/523 |

*Primary Examiner*—Howard N. Goldberg
*Assistant Examiner*—Steven Nichols
*Attorney, Agent, or Firm*—John W. Carpenter

[57] ABSTRACT

An apparatus and process for expanding a tube at selective points about its circumference to join another tube. After a segment of a first tube is inserted into a second tube having an end sleeve segment with a larger diameter and wall thickness than the first tube, compression and subsequent radial expansion of elastomeric bars lodged along the generally open sides of a bushing located within the first tube end segment cause the elastomeric bars to radially expand the wall of the first tube. The wall of the first tube expands at selective points against the wall of the second tube in proximity to their respective ends, creating a selective interference fit therebetween.

37 Claims, 9 Drawing Figures

APPARATUS AND PROCESS FOR SELECTIVELY EXPANDING TO JOIN ONE TUBE INTO ANOTHER TUBE

BACKGROUND OF THE INVENTION

1. Field of the Invention

The present invention relates to an improved apparatus and process for joining a tube inserted within another tube in proximity to the respective ends. More particularly, the improved apparatus and improved process of the present invention involve the compression and subsequent radial expansion of a pair of elastomeric bars positioned along the generally open sides of a bushing means. The elastomeric bars expand against the inner surface of the first tube at selective points causing selective expansion of the tube wall against the inner surface of the second tube to create a selective interference fit between the wall of the first tube and the wall of the second tube in proximity to their respective ends.

2. Description of the Prior Art

Prior art methods of expanding tubes include the use of metal rollers located inside the tube which move outwardly from a central position as the rollers are mechanically rotated about the central position. Such methods typically expand the tube only in a round shape about the entire circumference of the tube with the final shape of the tube being a concentric circle relative to the starting position of the tube. In our improved invention, longitudinal zones of expansion are used to mechanically lock the tubes together.

Other prior art such as U.S. Pat. No. 4,109,365 by Tygart involve the compression of hard rubber or polyurethane by piston forces applied from both ends of the tube, thereby making it difficult to expand the tube at greater distances from either end of the tube as when an expandable joint is made in tubular piling at the bottom of the ocean. Our invention utilizes a compression force applied from only one end of the tube thereby allowing an expansion to occur deep within the tube.

U.S. Pat. No. 4,152,821 by Scott teaches a process for joining a plastic pipe to a plastic or metal coupling by compression of a rubber plug against the inner walls of the plastic pipe. U.S. Pat. No. 4,420,866 by Mueller discloses an apparatus and process for expanding a tube selective points about its circumference to join with another tube.

We have considerably improved the invention disclosed in U.S. Pat. No. 4,420,866 which will be incorporated herein by reference. We have added a ring that threads to the outside of the outer cap in order to permit the axial position adjustment of the pair of elastomeric bars. This feature is not taught in U.S. Pat. No. 4,420,866. We have also removed the longitudinal slots including the retainers of the bushing and have opened the sides of the bushing in order to facilitate the lodging of the pair of elastomeric bars along the open sides. The bushing of the present invention with its open sides is generally figure eight in shape.

SUMMARY OF THE INVENTION

The present invention accomplishes its desired objects by broadly providing an improved apparatus and an improved process for expanding to join one tube into another tube in proximity to their respective ends by forming a selective interference fit therebetween. The improved apparatus comprises a first tube including a shaft extending axially inside the first tube, an inner cap bound to the shaft for longitudinal axially movement in combination with the shaft with respect to the first tube, and an outer cap slidably mounted on and along the shaft for longitudinal axial movement on and along the shaft with respect to the first tube. The outer cap include a structure whose outside surface defines a plurality of helical ridges. A ring means with an inner circumferential threaded surface is provided. The inner circumferential surface threadably mates with the plurality of helical ridges on the outside of the outer cap. At least one prong means is connected to the outer cap. The invention also comprises a bushing means, including at least one open side which longitudinal traverses the bushing means, slidably mounted on and along the shaft between the outer cap and the inner cap for longitudinal axial movement on and along the shaft with respect to the first tube. At least one elastomeric means is slidably lodged respectively along the open sides in order to contact the prong means. A second tube is provided with an end sleeve segment having a greater diameter than the first tube. The end sleeve segment defines a female opening to slidably mate with an end segment of the first tube, which includes the pair of elastomeric means therein, such that the inner surface of the end sleeve segment of the second tube overlaps the outer surface of the end segment of the first tube.

The invention also comprises a means for pulling the shaft in one axial direction while simultaneously pushing the outer cap in the opposite axial direction, such that the inner cap contacts the bushing means and the prong means contacts the elastomeric means. The continuing respective axial forces from pulling and pushing, in combination with the prong means that is connected to the outer cap and is in contact with the elastomeric means along the generally open side of the bushing means, compress and thereby radially expand the elastomeric means at predetermined selective locations against the end segment wall of the first tube. Selective radial expansion of the elastomeric means against the inner surface of the first tube end segment causes the first tube wall to selectively radially expand against the inner surface of the second tube to form a selective interference fit between the end segment wall of the first tube and the end sleeve segment wall of the second tube.

The present invention also accomplishes its desired objects by broadly providing a process for joining at least one pair of tubes by expanding a first tube into a second tube in proximity to their respective ends by forming a selective interference fit between the tubes. The process includes placing a shaft axially inside the first tube, mounting the bushing means slidably on and along the shaft, and mounting the outer cap slidably on and along the shaft for longitudinal axial movement. The process additionally comprises mating threadably the ring means on the outside of the outer cap, sizing the end sleeve segment of the second tube such that the end sleeve segment has a larger diameter than the first tube, registering the end segment of the first tube within the end sleeve segment of the second tube, and pulling the shaft in one axial direction while simultaneously pushing the outer cap in the opposite axial direction to radially expand the elastomeric means at predetermined selective locations against the end segment wall of the first tube. The selective radial expansion of the elastomeric means causes selective radial expansion of the end segment of the first tube against the end sleeve segment of the second tube to form a selective interference fit therebetween.

It is therefore an object of this invention to provide an improved process and an improved apparatus for expanding to join one tube into another tube in proximity to their respective ends.

It is another object of this invention to provide a process and apparatus for expanding to join one tube into another tube in proximity to their respective ends when either or both tubes are out-of-round.

These together with various ancillary objects and features which will become apparent as the following description proceeds are obtained by this novel improved apparatus and improved process preferred embodiments being shown in the accompanying drawings by way of example only, wherein:

BRIEF DESCRIPTION OF THE DRAWINGS

FIG. 9 is a partial enlarged segmented perspective view of an end segment of a first tube with an expanded region and a pipe with a groove to accept the expanded region for interlocking the first tube with the pipe. wherein:

DETAILED DESCRIPTION OF THE INVENTION

Figure 1:
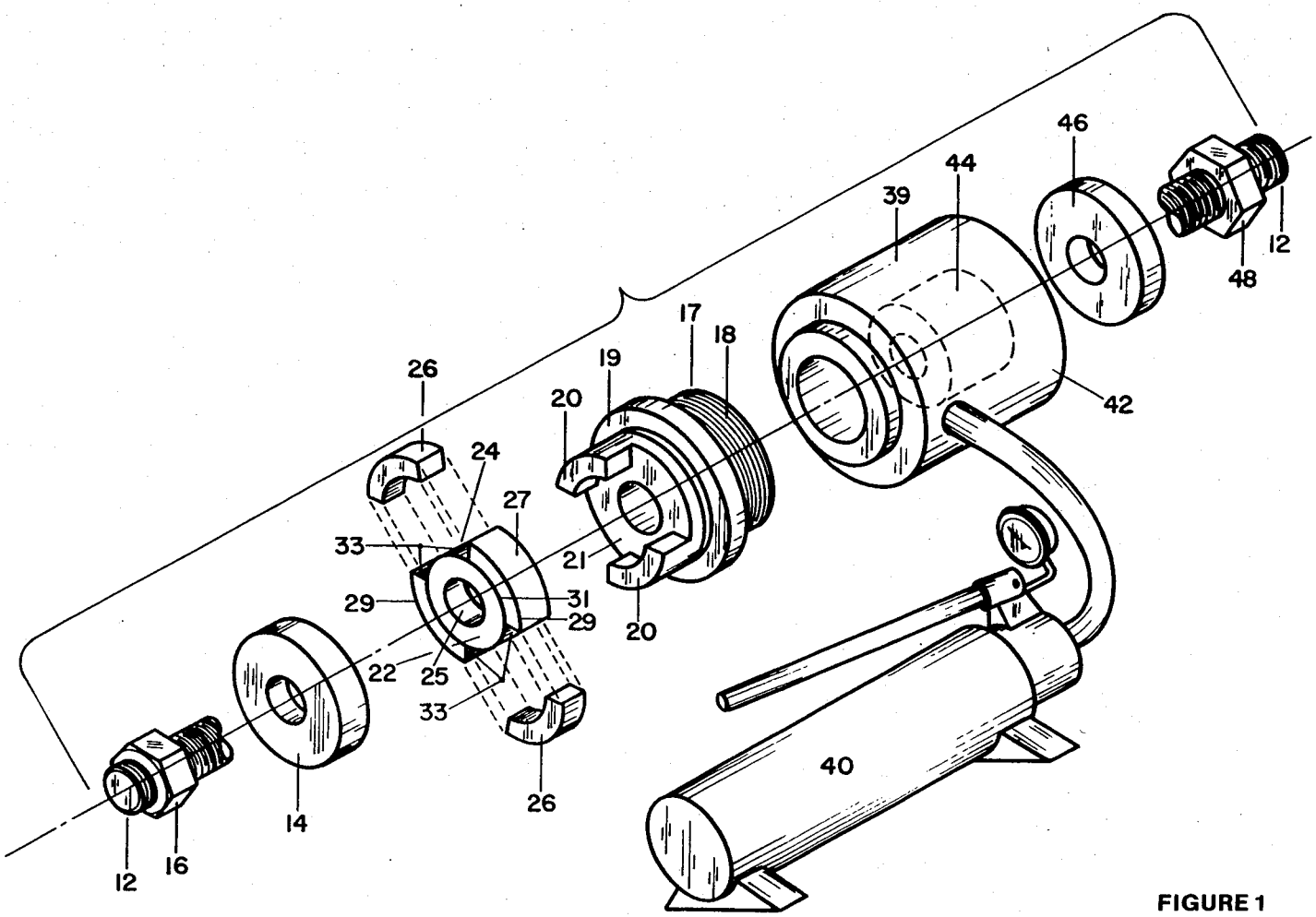
FIG. 1 is an enlarged segmented perspective view of the apparatus of this invention.

Referring in detail now to the drawings wherein like or similar parts of the invention are identified by like reference numerals, a first tube or pipe (or the like), generally illustrated as 10, is seen as including an end segment 11. A shaft, generally illustrated as 12, extends axially inside the first tube 10. Tube 10 may consist of any engineering metal alloy, such as A572 steel or ASTM-A53 Grade B steel. An inner cap 14 is bound to shaft 12 by a nut 16 for longitudinal axially movement in combination with shaft 12 with respect to the first tube 10. The minimum diameter of the shaft 12 is limited by the yield strength of the metal alloy used in its construction; however, it is normally about one-third the diameter of the first tube 10. An outer cap 18 is mounted on the shaft 12 so as to be able to slide on and along the shaft 12 in a longitudinal axial direction with respect to tube 10. The outer cap 18 includes a structure whose outside surface defines a plurality of helical ridges 17. A ring 19 is provided with an inner circumferential surface which is threaded. The inner circumferential surface of the ring 19 threadably mates with the plurality of helical ridges 17 on the outside of the outer cap 18 in order to affix adjustably the ring 19 to the outer cap 18.

At least one pair of or two prong means 20—20 is attached by screws to the inner face 21 of the outer cap 18. A bushing means 22 is slidably mounted on and along the shaft 12 between the inner cap 14 (which is preferably connected to or integrally bound to bushing means 22) and the outer cap 18 for longitudinal axial movement on and along the shaft 12 with respect to the tube 10. The bushing means 22 includes a structure generally defining at least one pair of or two generally open sides 24—24 which longitudinal traverse the bushing means 22 and is sized to mate with the prong means 20—20. Bushing means 22 has a structure defining a generally cylindrical center 25 and a pair of ends, each generally illustrated as 27—27, bound to the cylindrical center 25. Each of the ends 27—27 is geometrically defined by opposed arcuate sides 29,31 with arcuate side 31 being an inner arcuate side 31 integrally bound to the cylindrical center 25 and shorter in arcuate length than opposed arcuate side 29 which is an outer arcuate side 29. Each of the ends 27—27 additionally include a pair of straight sides 33—33 that flare divergently from the inner arcuate side 31 until terminating into the outer arcuate side 29. The bushing means 22 is basically figure eight in geometric shape.

At least one pair of elastomeric means or bars 26—26 is sized to slidably lodge respectively along the at least one pair of generally open sides 24—24 in order to contact the at least one pair of prong means 20—20. Elastomeric means 26—26 may consist of any elastomer; however, in a preferred embodiment the elastomer for the pair of elastomeric means 26—26 has a high resilience such as hard urethane rubber. Shaft 12, outer cap 18, inner cap 14, prong means 20—20, and bushing means 22 may be constructed of any material having a hardness and strength greater than that of the pair of elastomeric means 26—26.

In a preferred embodiment of the invention, only two prongs 20—20, two elastomeric means 26—26, and two open sides 24—24 are preferred, as depicted in the drawings. The two prongs 20—20 (and the registered two elastomeric means 26—26 and two open sides 24—24) are depicted in this preferred embodiment as being 90° apart. It should be understood that the spirit and the scope of the invention includes an expansion device for one prong 20, one elastomeric means 26 and one open side 24 and/or an expansion device for multiple prongs 20, multiple elastomeric means 26, and multiple open sides 24, all collimating such that each multiple sides 24 house each multiple elastomeric means 26 for compression contact with each of the multiple prongs 20. In order to join larger diameter pipes, it may be necessary and desirable to design the expansion device to have three prongs 20, three elastomeric means 26, and three sides 24, or four prongs 20, four elastomeric means 26, and four sides 24, etc.

Figure 6:
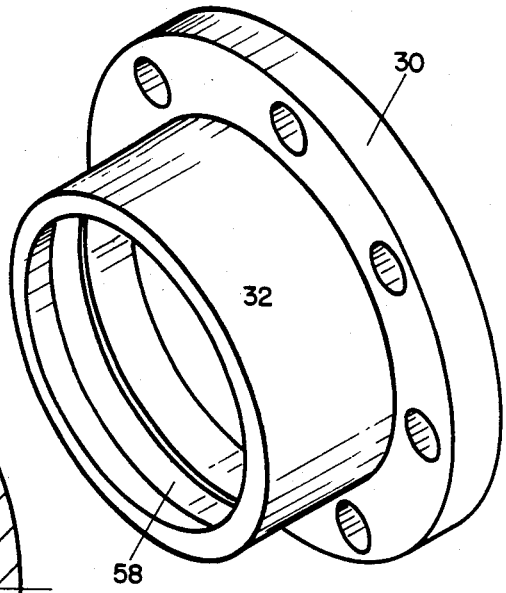
FIG. 6 is perspective view of the flange with a groove.
Figure 9:
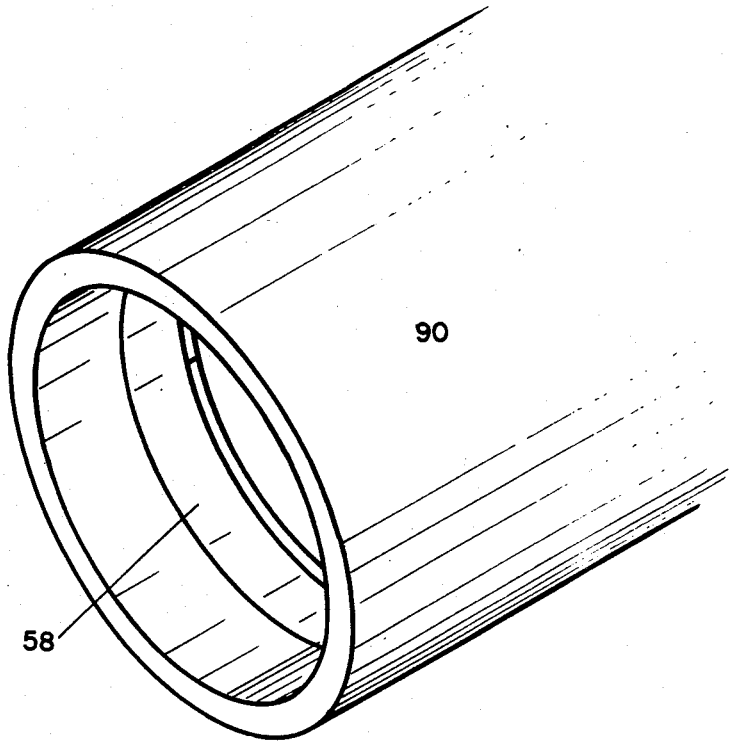
Figure 9:
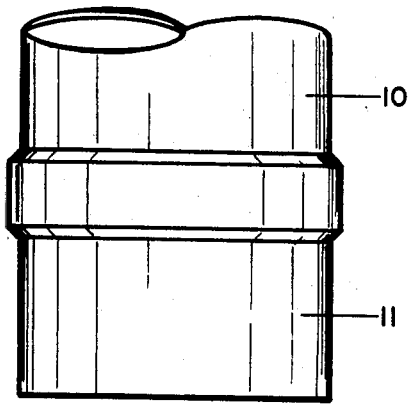

A flange or a second tube, generally illustrated as 30, is provided with an end sleeve 32. The tube 30 may consist of any engineering metal alloy, such as A572 or ASTM-A53 Grade B steel. The length of bushing means 22 and the pair of elastomeric means 26—26 depend upon the amount of contact required between the tube 10 and the flange 30 to prevent axial pullout. End sleeve segment 32 defines a female opening to slidably mate with end segment 11 of tube 10 such that the inner surface end sleeve segment 32 overlaps the outer surface of end segment 11. End segment 11 generally has the same diameter as the remainder of tube 10; however, the term "end segment" is used to illustrate that portion of tube 10 which is inserted into the end sleeve segment 32. It should be understood that in the spirit and scope of the invention, the flange 30 is merely a convenient way of describing the means or object that receives the selectively expanded metal. The flange 30 may not only be the hub of a flange (see FIG. 6), but may also be the bore of a hole in a large tube sheet, or any other large enough metal object (see pipe 90 in FIG. 9).

The bushing means 22 including the pair of elastomeric means 26—26 is located within the end segment 11. For ease of alignment, the pair of prongs 20—20 is registered within the generally open sides 24—24 of the bushing means 22 prior to locating the bushing means 22 and the outer cap 18 within the end segment 11. The invention also comprises a means, generally illustrated as 39, for pulling the shaft 12 in one axial direction, and upward direction when viewing FIG. 4, while simultaneously pushing outer cap 18 in the opposite axial direction, a downward direction when viewing FIG. 4, such that when the inner cap 14 contacts bushing means 22, the pair of prong means 20—20 respectively contacts the pair of elastomeric means 26—26. The push-pull means 39 is preferably exemplified by a hydraulic pump generally illustrated as 40, and a combination of an outer cylinder 42 and an inner cylinder 44 (see FIG. 1). Inner cylinder 44 is located inside outer cylinder 42 such that the longitudinal axes of both cylinders are concentrically aligned (see FIG. 4). The shaft 12 extends through outer cylinder 42 and inner cylinder 44 along their respective longitudinal axes. The shaft 12 is secured to the inner cylinder 44 by end cap 46 and nut 48. Fluid is delivered under pressure from pump 40 through a fluid conduit 50 into outer cylinder 42. The pressurized fluid acting against the inner surface of the outer cylinder 42 transmits a push force through outer cap 18 into the pair of elastomeric means 26—26 via the pair of prongs 20—20 while at the same time the fluid acting against the inner surface of outer cylinder 42 transmits a push force in the opposite direction through cap 46 to the shaft 12 (see FIG. 4). The continuing respective axial forces pushing in opposite directions against outer cap 18 and end cap 46, in combination with the pair of prong means 20—20 in contact with the pair of elastomeric means 26—26 within the openings 24—24 of the bushing means 22, compress and subsequently radially expand the pair of elastomeric means 26—26 at selective points against the inner surface of the end segment 11. The selective radial expansion of the pair of elastomeric means 26—26 against the end segment 11 causes the selective radial expansion of the end segment 11 against the end sleeve segment 32 to form a selective interference fit between the outer surface of the end segment 11 and the inner surface of the end sleeve segment 32. The resulting effect is to lock the tube 10 to the flange 30 to prevent axial pullout. In order to provide the end sleeve 32 with external hoop strength to counteract the expansion forces of the elastomeric means 26—26, the flange 30 including the end sleeve segment 32, may have a larger wall thickness to provide the necessary radial restraining force. Upon reversal of the push-pull means, the pair of elastomeric means 26—26 relaxes, allowing shaft 12 in combination with the inner cap 14, the outer cap 18, and the pair of elastomeric means 26—26 to be withdrawn from the tube 10.

Figure 7:
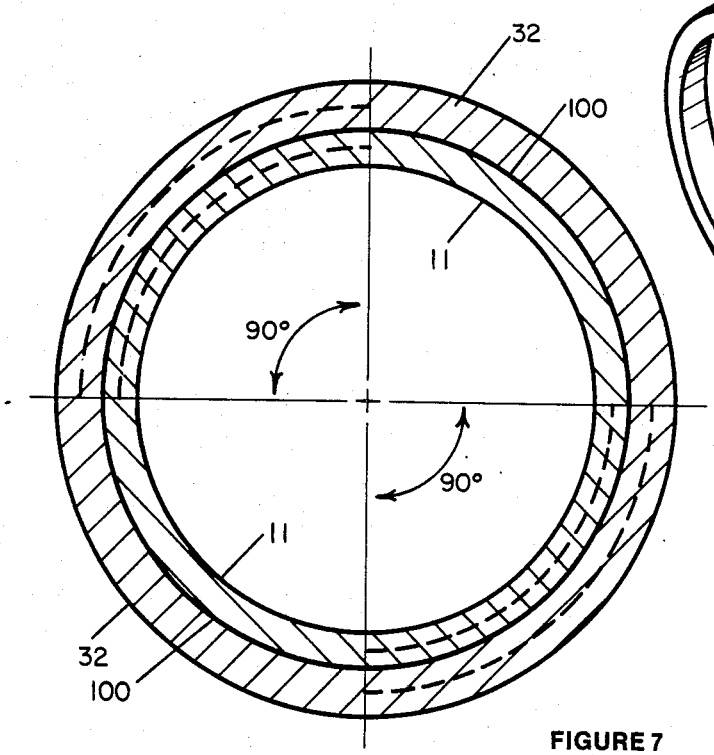
FIG. 7 is a top plan view disclosing a selective radial expansion of circumferential part of the first tube against the second tube.

In a preferred embodiment of the invention, after a selective inference fit has been made (see FIG. 7) between the outer surface of the end segment 11 and the inner surface of the end sleeve segment 32 and after the push-pull means has been reversed to relax the pair of elastomeric means 26—26, the entire device including the shaft 12 is turned or rotated a predetermined known certain amount (e.g. 90°), or until the elastomeric means 26—26 are opposed in proximity to a section(s) 100 (see FIG. 7) of the end segment 11 that has not been selectively radially expanded. Fluid is again delivered under pressure from pump 40 through the fluid conduit 50 into the outer cylinder 42. The pressurized fluid for the second time acts against the inner surface of the outer cylinder 42 in order to transmit a push force through the outer cap 18 into the pair of elastomeric means 26—26 via the prongs 20—20, while simultaneously the pressurized fluid acting against the inner surface of the outer cylinder 42 transmits a push force in the opposite direction through cap 46 to the shaft 12. As was the case for the previous selective inference fit, the continuing respective axial forces pushing in opposite directions, in combination with the prongs 20 in compressive contact with the elastomeric means 26 within the openings 24—24 of the bushing means 22, causes the elastomeric means 26—26 to radially expand against the inner surface section(s) 100 (see FIG. 7) of the end segment 11. The second radial expansion of the pair of elastomeric means 26—26 against section(s) 100 causes the radial expansion of the inner surface section(s) 100 against the end sleeve segment 32 to form another selective interference fit between the outer surface of the end segment 11 and the inner surface of the end sleeve segment 32. Preferably, the first selective interference fit between the outer surface of the end segment 11 and the inner surface of the end sleeve segment 32 is in contact communication with the second selective interference fit between the same. Depending on the number of prongs 20, and the number and size (i.e. arc size) of elastomeric means 26, the resulting effect of the second selective interference fit is to further or additionally lock the tube 10 to the flange 30 to prevent axial pullout.

Figure 8:
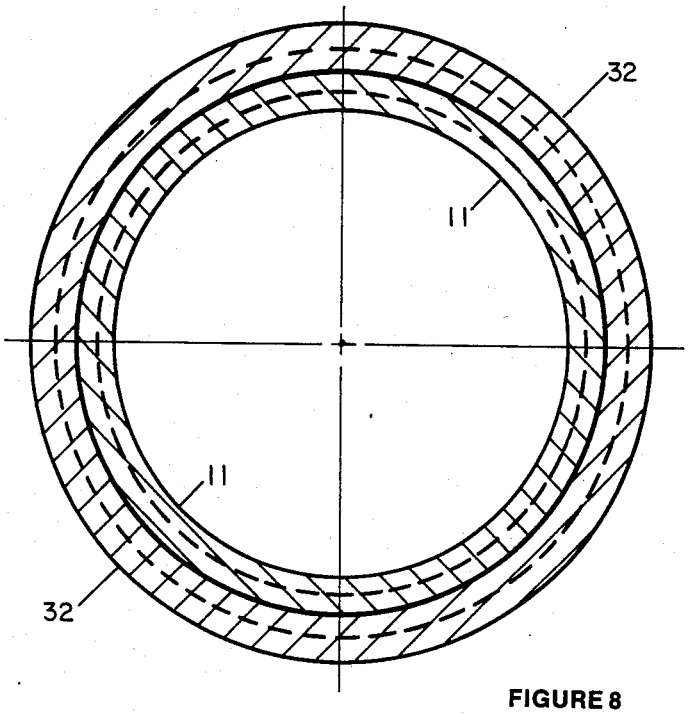
FIG. 8 is a top plan view disclosing complete radial 360° expansion of a circumferential part of the first tube against the second tube.
Figure 5:
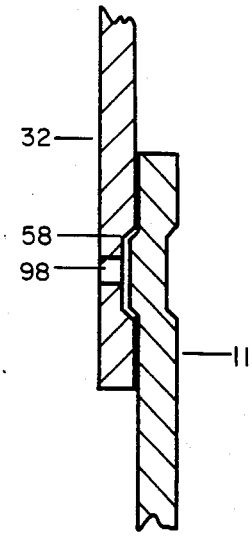
FIG. 5 is a partial enlarged perspective vertical sectional view of part of the end segment expanded into the groove, along with an aperture in the groove.

In a preferred embodiment of the invention, after the second selective interference fit, the entire device is again turned or rotated a predetermined certain amount and the entire process is repeated for each turn or rotation, a sufficient number of times (depending on the number of prongs 20 and the number and arc size of elastomeric means 26 utilized) to create an expanded zone in the end segment 11 that extends a full 360° around the end segment 11 (see FIG. 8). In this case, no passageways are created and a complete metal to metal seal (which is gas and water tight) is created between the selectively expanded, yet overlapping regions of metal. The overlapping expanded metal condition that extends a full 360° around the pipes 10 and flange 30, created by multiple actuations and rotations, is the key to the practical application of joining not only the flange 30 (see FIG. 6), to an end "of the pipe" 10, but also other metallic bodies to a pipe (See FIG. 10). Each individual actuation after a previous rotation requires less force and energy to expand the metal than any device that attempts to expand an entire 360° circumference of a tube or pipe all at once. Thus, the push-pull means 39 of this invention can be considerably smaller, especially in mechanical output, than those devices which attempt to expand all at once an entire 360° circumference of a tube or pipe.

Figure 2:
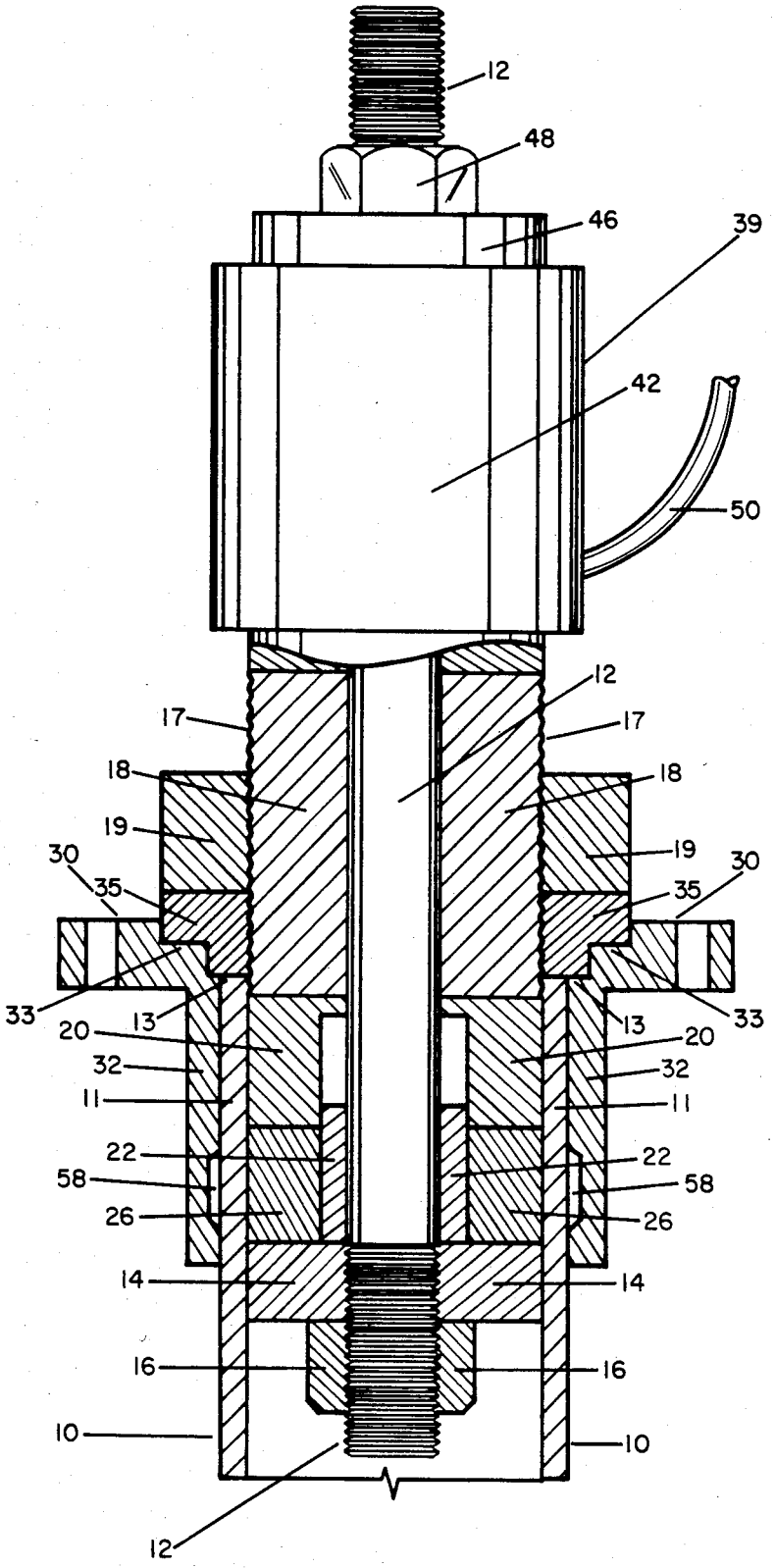
FIG. 2 is a longitudinal cross-section of the apparatus before tube expansion showing the push-pull means located outside of the tube along with a flange ring seated in a flange recess of a flange with a ring flushed against the flange ring, and an end segment of the first tube mated with a female opening of an end sleeve segment of the flange.

The push-pull means 39 is located exterior to the tube 10 as depicted in the drawings, and to outer cap 18 may be sized to extend from a location in proximity to the open end 11 of the tube 10 to the outer cylinder 42. The pair of prong means 20—20 is attached to the innerface 21 of the outer cap 18 and extend downwardly into the end segment 11 (see FIGS. 2, 3 and 4). The pair of prong means 20—20 contact the pair of elastomeric means 26—26 which are located in proximity to the area of proposed expansion inside the tube 10.

Figure 3:
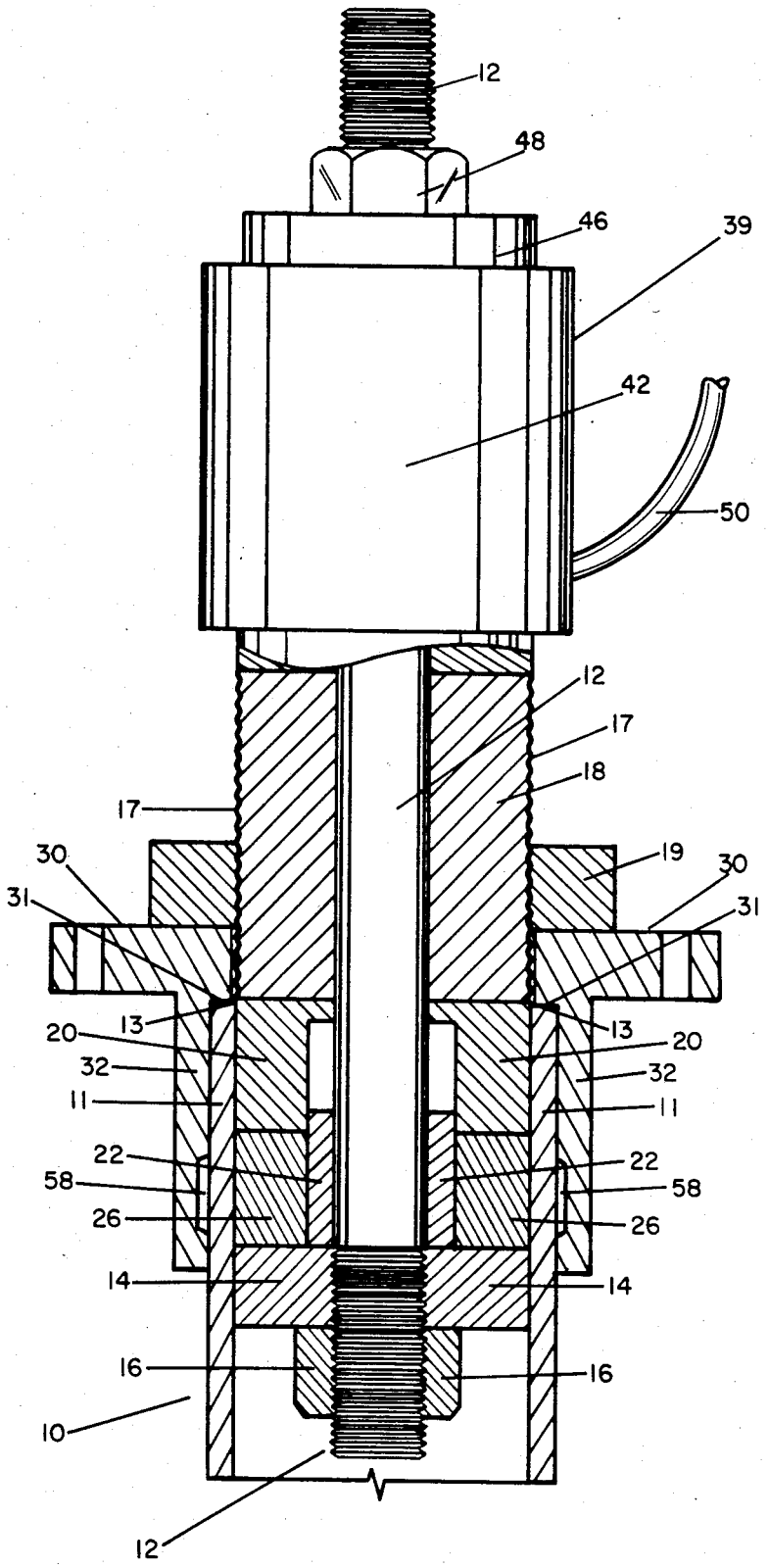
FIG. 3. is a longitudinal cross-section of the apparatus before tube expansion showing the push-pull means located outside of the tube with the flange having a flange lip and the ring flushed against the flange, and an end segment of the first tube mated with a female opening of an end sleeve segment of the flange.
Figure 4:
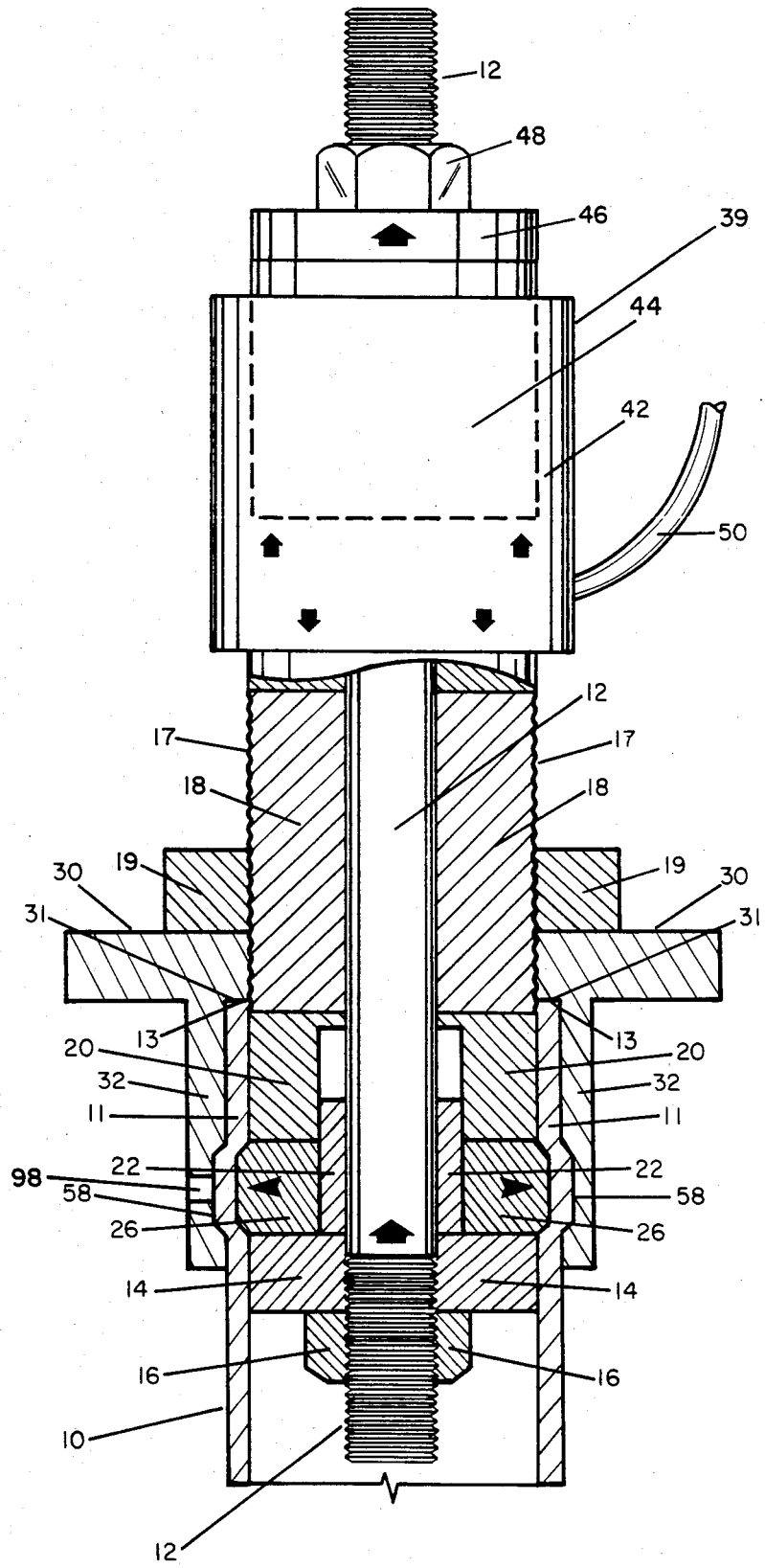
FIG. 4 is a longitudinal cross-section of the apparatus showing the end segment of the first tube joined by selective expansion with the end sleeve segment of the second tube.

In order to aid and assist the alignment of the elastomeric means 26—26 in proximity to the area of proposed expansion inside the tube 10, ring 19 may be threadably set longitudinally along the threads of the outer cap 18 such that the prong means 20—20 may drive the elastomeric means 26—26 against the area of the end segment 11 to be expanded. Thus, the ring 19 mating threadably with the plurality of helical ridges 17 on the outside of the outer cap 18 permits the axial position (or vertical) adjustment of the elastomeric means 26—26. The ring 19 also keeps the elastomeric means 26—26 (along with the prong means 20—20) aligned horizontally (in a horizontal plane) by flushing against the outer face of the flange 30 as depicted in FIGS. 3 and 4. In the embodiment of the invention in FIGS. 3 and 4, flange 30 has a lip 31 which abuts and is flushed by an end 13 of the end segment 11 such that the flange 30 is sandwiched between the end 13 of the end segment 11 and the ring 19 when the latter is firmly tightened along the helical ridges 17 against the outer face of the flange 30. In the embodiment of the invention in FIG. 2, the flange 30 has no lip 31, but includes a flange recess 33 for receiving a flange ring 35 that seats in the recess 33 such that the end 13 of the end segment 11 may flush against the bottom of the flange ring 35.

In this embodiment of the invention, the end 13 of the end segment 11 and ring 19 when tightened, sandwich the flange ring 35 and align both axially (vertically) and horizontally, the elastomeric means 26—26 against the area of the end segment 11 to be expanded.

In order to increase the resistance of the tube 10 and the flange 30 to axial pullout, the end sleeve segment 32, as depicted in FIGS. 2, 3,4, 5 and 6 may include a groove 58. Grove 58 may also be included in the pipe 90 (of FIG. 9) in order to join the pipe 90 and end segment 11 of tube 10 together (which in FIG. 9 has been expanded). Preferably, groove 58 is located along the inner surface of the end sleeve 32 and about the circumference of the inner surface such that the wall of the end segment 11 is selectively radially expanded within the groove 58 in a radial direction. Expansion of the end segment 11 within the groove 58 creates a mechanical lock resulting in stronger resistance to axial pullout of the tube 10 from the tube 30. An aperture 98 (see FIG. 4 and 5) may be radially positioned through the side of the flange 30 and into the groove 58. This creates a passageway through which commercial adhesives, such as epoxies, can be injected after joining together the tube 10 and the flange 30. The adhesives serve to add pull-out strength or resistance to the departure of the tube 10 with the flange 30. The adhesives can also serve as a redundant seal over and above any metal seal that has been created.

In order that the compression forces of inner cap 14 and prong means 20—20 are fully transmitted to the pair of elastomeric means 26—26 and then to the inner surface of end segment 11, the outer edge of the inner cap 14, the outer edge of the outer cap 18 and the outer surface of the prong means 20—20 are sized to generally conform to the size and shape of the inner surface of the end segment 11. Additionally, the pair of prong means 20—20 is sized to generally conform to the size and shape of the openings 24—24 of the bushing means 22. Application of compression forces over the entire end surface of the pair of elastomeric means 26—26 assures maximum compression and therefore maximum selective radial expansion of elastomeric means 26—26 to the inner surface of end segment 11.

While the present invention as been described herein with reference to particular embodiments thereof, a latitude of modification. various changes and substitutions are introduced in the foregoing disclosure, and in some instances some features of the invention would be employed without a corresponding use of others without departing from the scope of the invention as set forth.

We claim:

1. A process for joining at least one pair of tube means, or the like, by radially expanding a first tube means, or the like, into a second tube means in proximity to their respective ends to form an interference fit between the tube means comprising the following steps:

(a) placing a shaft means axially inside a first tube means, said shaft means having an inner cap means bound thereto for longitudinal axial movement in combination with the shaft means with respect to the first tube means;

(b) mounting a bushing means, including at least one generally open side which longitudinally traverse said bushing means, slidably on and along the shaft means for longitudinal axial movement on and along the shaft means with respect to the first tube means, said bushing means having at least one elastomeric means slidably lodged respectvely along the generally open side;

(c) mounting an outer cap means, including at least one prong means connected thereto, slidably on and along the shaft means for longitudinal axial movement on and along the shaft with respect to the first tube means such that said prong means is slidably lodged along the generally open side of said bushing means, said outer cap means structure whose outside surface defines a plurality of helical ridges and is positioned on the shaft means such that said elastomeric means is between said prong means and said inner cap means;

(d) mating threadably a ring means with the plurality of helical ridges on said outside of said outer cap means to permit the axial position adjustment of said elastomeric means;

(e) sizing an end sleeve segment means of the second tube means such that said end sleeve segment has a larger diameter than the first tube means;

(f) registering an end segment means of the first tube means, which includes the elastomeric means therein, within the end sleeve segment means of the second tube means such that the inner surface means of the end sleeve segment means of the second tube means overlaps the end segment means outer surface of the first tube means; and (g) pulling the shaft means in one axial direction while simultaneously pushing the outer cap means in the opposite axial direction such that when the inner cap means contacts the bushing means, and when the prong means connected to said outer cap means contacts the elastomeric means the continuing respective axial forces from pulling and pushing, in combination with the elastomeric means along the open side, compress and thereby radially expand the elastomeric means at predetermined selective locations against the end segment wall means of the first tube means causing radial expansion of the wall of the first tube end segment against the inner surface of the end sleeve segment means of the second tube means to form an interference fit therebetween.

2. The process for joining at least one pair of tube means by an interference fit as recited in claim 1 additionally comprising locating the means for pulling the shaft means in one axial direction while simultaneously pushing the outer cap means in the opposite axial direction outside the first tube.

3. The process for joining at least one pair of tube means by an interference fit as recited in claim 2 additionally comprising sizing the outer cap means to extend longitudinally on the shaft means from a location in proximity to an open end of the first tube means to the bushing means, when said inner cap means is in contact with said bushing means and the prong means of said outer cap means is in contact with said elastomeric means.

4. The process for joining at least one pair of tube means by an interference fit as recited in claim 1 additionally comprising grooving the inner surface of the end sleeve segment means of the second tube means before said registering step such that when the end segment wall means of the first tube means is radially expanded within said groove an interference fit is formed between the end segment wall of the first tube means and said groove.

5. The process for joining at least one pair of tube means by an interference fit as recited in claim 4 additionally comprising sizing the outer edge of the inner cap means, the outer edge of the outer cap means and part of the outer surface of the bushing means to generally conform to the shape and size of the end segment inner surface of the first tube means, and sizing the prong means to generally conform to the generally open side of the bushing means.

6. The process for joining at least one pair of tube means by an interference fit as recited in claim 4 additionally comprising reversing said pulling step in order to relax the elastomeric means.

7. The process for joining at least one pair of tube means by an interference fit as recited in claim 4 additionally comprising reversing said pulling step in order to relax the elastomeric means; and rotating a predetermined known certain amount inside the first tube means said shaft means including the mounted bushing means with the slidably lodged elastomeric means along the generally open side thereof and the mounted outer cap means including the prong means connected thereto, in order to radially expand the elastomeric means at selective locations against the end segment wall means of the first tube means that have not been selectively radially expanded already to cause radial expansion of the wall of the first tube end segment that has not been already radially expanded against the inner surface of the end sleeve segment means of the second tube means to form an additional interference fit therebetween.

8. The process for joining at least one pair of tube means by an interference fit as recited in claim 4 additionally comprising positioning radially an aperture means through the end segment wall means of the second tube means and into the groove.

9. The process for joining at least one pair of tube means by an interference fit as recited in claim 4 additionally comprising positioning radially an aperture means through the end segment wall means of the second tube means and into the groove and injecting an adhesive means through said aperture means and into said groove.

10. A process for joining at least one pair of tube means by radially expanding a first tube means into a second tube means in proximity to their respective ends to form an interference fit between the tube means comprising the following steps:

(a) placing a shaft means axially inside a first tube means, said shaft means having an inner cap means bound thereto for longitudinal axial movement in combination with the shaft means with respect to the first tube means;

(b) mounting a bushing means, including at least one generally open side which longitudinally traverse said bushing means, slidably on and along the shaft means for longitudinal axial movement on and along the shaft means with respect to the first tube means, said bushing means having at least one elastomeric means slidably lodged respectively along the generally open side;

(c) mounting an outer cap means, including at least one prong means connected thereto, slidably on and along the shaft means for longitudinal axial movement on and along the shaft with respect to the first tube means such that said prong means is slidably lodged along the generally open side of said bushing means, said outer cap means structure whose outside surface defines a plurality of helical ridges and is positioned on the shaft means such that said elastomeric means is between said prong means and said inner cap means;

(d) mating threadably a ring means with the plurality of helical ridges on said outside of said outer cap means to permit the axial position adjustment of said elastomeric means;

(e) sizing an end sleeve segment means of the second tube means such that said end sleeve segment has a larger diameter than the first tube means;

(f) grooving the inner surface of the end sleeve segment means of the second tube means to define a groove therein;

(g) registering an end segment means of the first tube means, which includes the elastomeric mean therein, within the end sleeve segment means of the second tube means such that the inner surface means of the end sleeve segment means of the second tube means overlaps the end segment means outer surface of the first tube means; and (h) pulling the shaft means in one axial direction while simultaneously pushing the outer cap means in the opposite axial direction such that when the inner cap means contacts the bushing means, and when the prong means connected to said outer cap means contacts the elastomeric means the continuing respective axial forces from pulling and pushing, in combination with the elastomeric means along the open side, compress and thereby radially expand the elastomeric means at predetermined selective locations against the end segment wall means of the first tube means causing radial expansion of the wall of the first tube end segment within said groove of the inner surface of the end sleeve segment means of the second tube means to form an interference fit therebetween.

11. A process for joining at least one pair of tube means by radially expanding a first tube means into a second tube means in proximity to their respective ends to form an interference fit between the tube means comprising the following steps:

(a) placing a shaft means axially inside a first tube means, said shaft means having an inner cap means bound thereto for longitudinal axial movement in combination with the shaft means with respect to the first tube means;

(b) mounting a bushing means, including at least one generally open side which longitudinally traverse said bushing means, slidably on and along the shaft means for longitudinal axial movement on and along the shaft means with respect to the first tube means, said bushing means having at least one elastomeric means slidably lodged respectively along the generally open side;

(c) mounting an outer cap means, including at least one prong means connected thereto, slidably on and along the shaft means for longitudinal axial movement on and along the shaft with respect to the first tube means such that said prong means is slidably lodged along the generally open side of said bushing means, said outer cap means structure whose outside surface defines a plurality of helical ridges and is positioned on the shaft means such that said elastomeric means is between said prong means and said inner cap means;

(d) mating threadably a ring means with the plurality of helical ridges on said outside of said outer cap means to permit the axial position adjustment of said elastomeric means;

(e) sizing an end sleeve segment means of the second tube means such that said end sleeve segment has a larger diameter than the first tube means;

(f) grooving the inner surface of the end sleeve segment means of the second tube means to define a groove therein;

(g) registering an end segment means of the first tube means, which includes the elastomeric means therein, within the end sleeve segment means of the second tube means such that the inner surface means of the end sleeve segment means of the second tube means overlaps the end segment means outer surface of the first tube means;

(h) pulling the shaft means in one axial direction while simultaneously pushing the outer cap means in the opposite axial direction such that when the inner cap means contacts the bushing means, and when the prong means connected to said outer cap means contacts the elastomeric means the continuing respective axial forces from pulling and pushing, in combination with the elastomeric means along the open side, compress and thereby radially expand the elastomeric means at predetermined selective locations against the end segment wall means of the first tube means causing radial expansion of the wall of the first tube end segment within said groove of the inner surface of the end sleeve segment means of the second tube means to form an interference fit therebetween;

(i) reversing said pulling step (h) in order to relax the elastomeric means; and rotating a predetermined known certain amount inside the first tube means said shaft means including the mounted bushing means with the slidably lodged elastomeric means along the generally open side thereof and the mounted outer cap means including the prong means connected thereto, in order to radially expand the elastomeric means at selective locations against the end segment wall means of the first tube means that have not been selectively radially expanded already to cause radial expansion of the wall of the first tube end segment that has not been already radially expanded against the inner surface of the end sleeve segment means of the second tube means to form an additional interference fit therebetween.

12. The process for joining at least one pair of tube means by an interference fit as recited in claim 11 additionally comprising locating the means for pulling the shaft means in one axial direction while simultaneously pushing the outer cap means in the opposite axial direction outside the first tube.

13. The process for joining at least one pair of tube means by an interference fit as recited in claim 12 additionally comprising sizing the outer cap means to extend longitudinally on the shaft means from a location in proximity to an open end of the first tube means to the bushing means, when said inner cap means is in contact with said bushing means and the prong means of said outer cap means is in contact with said elastomeric means.

14. The process for joining at least one pair of tube means by an interference fit as recited in claim 12 additionally comprising sizing the outer edge of the inner cap means, the outer edge of the outer cap means and part of the outer surface of the bushing means to generally conform to the shape and size of the end segment inner surface of the first tube means, and sizing the prong means to generally conform to the generally open side of the bushing means.

15. The process for joining at least one pair of tube means by an interference fit as recited in claim 11 additionally comprising positioning radially an aperture means through the end segment wall means of the first tube means and into the groove.

16. The process for joining at least one pair of tube means by an interference fit as recited in claim 11 additionally comprising positioning radially an aperture means through the end segment wall means of the first tube means and into the groove and injecting an adhesive means through said aperture means and into said groove.

17. An apparatus for joining a pair of tube means, or the like, by selectively radially expanding a first tube means, or the like, into a second tube means, or the like, in proximity to their respective ends to form an interference fit between the tube means comprising:

(a) a shaft means;
(b) an inner cap means bound to the shaft;
(c) an outer cap means slidably mounted on and along the shaft means and including a structure whose outside surface defines a plurality of helical ridges;
(d) a ring means whose inner circumferential surface is threaded, said inner circumferential surface threadably mates with the plurality of helical ridges of said outside of said outer cap means;
(e) at least one prong means connected to said outer cap means;
(f) a bushing means slidably mounted on and along the shaft means between the outer cap means and the inner cap means for longitudinal axial movement on and along the shaft means, and said bushing means including a structure generally defining at least one generally open side which longitudinally traverses said bushing means and slidably receives said prong means;
(g) at least one elastomeric means slidably lodged respectively along the generally open sides in order to contact said prong means;
(h) a means for pulling the shaft means in one axial direction while simultaneously pushing the outer cap means in the opposite axial direction such that when the inner cap means contacts the bushing means and the prong means contacts the elastomeric means the continuing respective axial forces from pulling and pushing in combination with the prong means in contact with the elastomeric means along the generally open side, compress and thereby radially expand the elastomeric means at predetermined selective points against an end segment wall of the first tube means causing said wall to expand against the inner surface of the end sleeve segment of the second tube means to form an interference fit therebetween.

18. The apparatus for joining at least one pair of tube means by an interference fit as recited in claim 17 wherein the means for pulling the shaft means in one axial direction while simultaneously pushing the outer cap means in the opposite axial direction is located outside the first tube means.

19. The apparatus for joining at least one pair of tube means by an interference fit as recited in claim 17 wherein when said inner cap means is in contact with said bushing means and the prong means is in contact with said elastomeric means.

20. The apparatus for joining at least one pair of tube means by an interference fit as recited in claim 17 wherein said bushing means has a structure defining a generally cylindrical center and a pair of ends bound to said cylindrical center; each of said ends is geometrically defined by a pair of opposed arcuate sides with one arcuate side being an inner arcuate side integrally bound to said cylindrical center and shorter in length than the other opposed arcuate side which is an outer arcuate side, and a pair of straight sides that flares divergently from said inner arcuate side until terminating into said outer arcuate side.

21. The apparatus for joining at least one pair of tube means by an interference fit as recited in claim 17 wherein said means for pulling the shaft means in one axial direction while simultaneously pushing the outer cap means in the opposite axial direction comprises a hydraulic pump means; an outer cylinder means; an inner cylinder means positioned inside said outer cylinder means such that the longitudinal axes of said outer and said inner cylinder means are concentrically aligned, said shaft means extends through said outer cylinder means and through said innner cylinder means along their respective longitudinal axes; and a conduit means extended from said hydraulic pump means to and through said outer cylinder means.

22. The apparatus for joining at least one pair of tube means by an interference fit as recited in claim 17 additionally comprising an end cap means slidably mounted around the shaft and flushed against said outer cylinder means, and a nut means threadably secured to said shaft means to hold said end cap means against said outer cylinder means.

23. An apparatus for joining at least one pair of tube means, or the like, by radially expanding a first tube means, or the like, into a second tube means, or the like, in proximity to their respective ends to form an interference fit between the tube means comprising:
(a) the first tube means including a shaft means extending axially therein;
(b) an inner cap bound means to the shaft for longitudinal axial movement in combination with the shaft with respect to the first tube means;
(c) an outer cap means slidably mounted on and along the shaft means for longitudinal axial movement on and along the shaft means with respect to the first tube means, said outer cap means including a structure whose outside surface defines a plurality of helical ridges;
(d) a ring means whose inner circumferential surface is threaded, said inner circumferential surface threadably mates with the plurality of helical ridges of said outside of said outer cap means;
(e) at least one prong means connected to said outer cap means;
(f) a bushing means slidably mounted on and along the shaft means between the outer cap means and the inner cap means for longitudinal axial movement on and along the shaft means with respect to the first tube means, said bushing means including a structure generally defining at least one generally open side which longitudinally traverses said bushing means and slidably receives said prong means;
(g) at least one elastomeric means slidably lodged respectively along the generally open sides in order to contact said prong means;
(h) the second tube means with an end sleeve segment means having a greater diameter than the first tube means, said end sleeve segment means defining a female opening to slidably mate with an end segment of said first tube, which includes said elastomeric means therein, such that the inner surface of the end sleeve segment means of the second tube means overlaps the outer surface of the end segment means of the first tube means; and
(i) a means for pulling the shaft means in one axial direction while simultaneously pushing the outer cap means in the opposite axial direction such that when the inner cap means contacts the bushing means and the prong means contacts the elastomeric means the continuing respective axial forces from pulling and pushing in combination with the prong means in contact with the elastomeric means along the generally open side, compress and thereby radially expand the elastomeric means at predetermined selective points against the end segment wall of the first tube means causing said wall to expand against the inner surface of the end sleeve segment of the second tube means to form an interference fit therebetween.

24. The apparatus for joining at least one pair of tube means by an interference fit as recited in claim 23 wherein said end sleeve segment means of the second tube means has a structure defining a groove means, said groove means is positioned on the inner surface such that the end segment wall of the first tube is radially expanded within said groove means to form an interference fit between the end segment wall of the first tube means and said groove means.

25. The apparatus for joining at least one pair of tube means by an interference fit as recited in claim 23 wherein the means for pulling the shaft means in one axial direction while simultaneously pushing the outer cap means in the opposite axial direction is located outside the first tube means.

26. The apparatus for joining at least one pair of tube means by an interference fit as recited in claim 25 wherein when said inner cap means is in contact with said bushing means and the prong means is in contact with said elastomeric means, said outer cap means is sized to extend longitudinally on the shaft means from a location in proximity to an open end of the first tube means to the bushing means.

27. The apparatus for joining at least one pair of tube means by an interference fit as recited in claim 23 wherein the outer edge of the inner cap means, the outer edge of the outer cap means and the part of the outer surface of the bushing means are sized to generally conform to the shape and size of the end segment inner surface of the first tube means, and the prong means is sized to generally conform to the circumferential size and shape of the generally open side of the bushing means.

28. The apparatus for joining at least one pair of tube means by an interference fit as recited in claim 23 wherein said bushing means has a structure defining a generally cylindrical center and a pair of ends bound to said cylindrical center; each of said ends is geometrically defined by a pair of opposed arcuate sides with one arcuate side being an inner arcuate side integrally bound to said cylindrical center and shorter in length than the other opposed arcuate side which is an outer arcuate side, and a pair of straight sides that flares divergently from said inner arcuate side until terminating into said outer arcuate side.

29. The apparatus for joining at least one pair of tube means by an interference fit as recited in claim 23 wherein said means for pulling the shaft means in one axial direction while simultaneously pushing the outer cap means in the opposite axial direction comprises a hydraulic pump means; an outer cylinder means; an inner cylinder means positioned inside said outer cylinder means such that the longitudinal axes of said outer and said inner cylinder means are concentrically aligned, said shaft means extends through said outer cylinder means and through said innner cylinder means along their respective longitudinal axes; and a conduit means extended from said hydraulic pump means to and through said outer cylinder means.

30. The apparatus for joining at least one pair of tube means by an interference fit as recited in claim 23 additionally comprising an end cap means slidably mounted around the shaft and flushed against said outer cylinder means, and a nut means threadably secured to said shaft means to hold said end cap means against said outer cylinder means.

31. The apparatus for joining at least one pair of tube means by an interference fit as recited in claim 23 wherein said second tube means is a flange means.

32. The apparatus for joining at least one pair of tube means by an interference fit as recited in claim 24 wherein the end sleeve segment of said second tube means additionally has a structure defining at least one aperture extending there through and into the groove means in order that the groove means can communicate with the outside of the end sleeve segment means of the second tube means.

33. The apparatus for joining at least one pair of tube means by an interference fit as recited in claim 32 additionally including an adhesive means positioned between the groove means and the end segment wall means of the first tube means.

34. An apparatus for joining at least one pair of tube means, or the like, by selectively radially expanding a first tube means, or the like, into a second tube means, or the like, in proximity to their respective ends to form an interference fit between the tube means comprising:

(a) shaft means;

(b) an inner cap bound means to the shaft means;

(c) an outer cap means slidably mounted on and along the shaft means, said outer cap means including a structure whose outside surface defines a plurality of helical ridges;

(d) a ring means whose inner circumferential surface is threaded, said inner circumferential surface threadably mates with the plurality of helical ridges of said outside of said outer cap means;

(e) at least one prong means connected to said outer cap means;

(f) a bushing means slidably mounted on and along the shaft means between the outer cap means and the inner cap means, said bushing means including a structure generally defining at least one generally open side which longitudinally traverses said bushing means and slidably receives said prong means;

(g) at least one elastomeric means slidably lodged respectively along the generally open side(s) of the bushing means in order to contact said prong means;

(h) a means for pulling the shaft means in one axial direction while simultaneously pushing the outer cap means in the opposite axial direction such that when the inner cap means contacts the bushing means and the prong means contacts the elastomeric means the continuing respective axial forces from pulling and pushing in combination with the prong means in contact with the elastomeric means along the generally open side, compress and thereby radially expand the elastomeric means, the means for pulling the shaft means in one axial direction while simultaneously pushing the outer cap means in the opposite axial direction is located outside the first tube means; and said inner cap means is in contact with said bushing means and the prong means is in contact with said elastomeric means.

35. The apparatus for joining at least one pair of tube means by an interference fit as recited in claim 34 wherein said bushing means has a structure defining a generally cylindrical center and a pair of ends bound to said cylindrical center; each of said ends is geometrically defined by a pair of opposed arcuate sides with one arcuate side being an inner arcuate side integrally bound to said cylindrical center and shorter in length than the other opposed arcuate side which is an outer arcuate side, and a pair of straight sides that flares divergently from said inner arcuate side until terminating into said outer arcuate side.

36. The apparatus for joining at least one pair of tube means by an interference fit as recited in claim 35 wherein said means for pulling the shaft means in one axial direction while simultaneously pushing the outer cap means in the opposite axial direction comprises a hydraulic pump means; an outer cylinder means; an inner cylinder means positioned inside said outer cylinder means such that the longitudinal axes of said outer and said inner cylinder means are concentrically aligned, said shaft means extends through said outer cylinder means and through said innner cylinder means along their respective longitudinal axes; and a conduit means extended from said hydraulic pump means to and through said outer cylinder means.

37. The apparatus for joining at least one pair of tube means by an interference fit as recited in claim 36 additionally comprising an end cap means slidably mounted around the shaft and flushed against said outer cylinder means, and a nut means threadably secured to said shaft means to hold said end cap means against said outer cylinder means.

* * * * *